US008690968B2

(12) United States Patent
Schwab

(10) Patent No.: US 8,690,968 B2
(45) **Date of Patent: *Apr. 8, 2014**

(54) SUCCINIMIDE LUBRICITY ADDITIVE FOR DIESEL FUEL AND A METHOD FOR REDUCING WEAR SCARRING IN AN ENGINE

(75) Inventor: Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 1237 days.

This patent is subject to a terminal disclaimer.

(21) Appl. No.: 12/098,149

(22) Filed: Apr. 4, 2008

(65) Prior Publication Data

US 2009/0249683 A1 Oct. 8, 2009

(51) Int. Cl.

| | |
|---|---|
| ***C10L 1/222*** | (2006.01) |
| ***C10L 1/224*** | (2006.01) |
| ***C10L 1/228*** | (2006.01) |

(52) U.S. Cl.
USPC ..... 44/347; 44/331

(58) Field of Classification Search
USPC ..... 44/347, 331
See application file for complete search history.

(56) References Cited

U.S. PATENT DOCUMENTS

| | | | | |
|---|---|---|---|---|
| 3,172,892 | A | 3/1965 | Le Suer et al. | |
| 3,202,678 | A | 8/1965 | Stuart et al. | |
| 3,216,936 | A | 11/1965 | Le Suer | |
| 3,219,666 | A | 11/1965 | Norman et al. | |
| 3,254,025 | A | 5/1966 | Le Suer | |
| 3,272,746 | A * | 9/1966 | Le Suer et al. | 508/554 |
| 3,361,673 | A | 1/1968 | Stuart et al. | |
| 3,676,089 | A | 7/1972 | Herbert et al. | |
| 4,152,499 | A | 5/1979 | Boerzel et al. | |
| 4,234,435 | A | 11/1980 | Meinhardt et al. | |
| 4,240,803 | A | 12/1980 | Andress, Jr. | |
| 4,482,356 | A | 11/1984 | Hanlon | |
| 4,605,808 | A | 8/1986 | Samson | |
| 4,613,341 | A * | 9/1986 | Zaweski et al. | 44/325 |
| 4,968,321 | A | 11/1990 | Sung et al. | |
| 5,358,651 | A * | 10/1994 | Walsh | 508/290 |
| 5,393,309 | A | 2/1995 | Cherpeck | |
| 5,575,823 | A | 11/1996 | Wallace et al. | |
| 5,620,486 | A | 4/1997 | Cherpeck | |
| 6,606,856 | B1 * | 8/2003 | Brown et al. | 60/299 |
| 6,648,929 | B1 * | 11/2003 | Daly et al. | 44/301 |
| 6,719,814 | B1 | 4/2004 | Lin | |
| 2003/0096713 | A1 | 5/2003 | Schnur et al. | |
| 2003/0177692 | A1 | 9/2003 | Arters et al. | |
| 2004/0139931 | A1 * | 7/2004 | Duncan et al. | 123/25 A |
| 2005/0039381 | A1 * | 2/2005 | Langer et al. | 44/301 |
| 2005/0120619 | A1 | 6/2005 | Koch et al. | |
| 2008/0289249 | A1 | 11/2008 | Hou et al. | |
| 2009/0149358 | A1 * | 6/2009 | Rhoads et al. | 508/306 |

FOREIGN PATENT DOCUMENTS

| | | | |
|---|---|---|---|
| CA | 1148925 | | 6/1983 |
| CA | 1148925 | A1 | 6/1983 |
| CA | 2420818 | | 9/2003 |
| CA | 2420818 | A1 | 9/2003 |
| CA | 2492982 | | 8/2005 |
| CA | 2492982 | A1 | 8/2005 |
| EP | 0020037 | | 12/1980 |
| EP | 0020037 | A | 12/1980 |
| EP | 0020307 | A1 | 12/1980 |
| EP | 0889111 | | 1/1999 |
| EP | 1116779 | A1 | 7/2001 |
| EP | 1151994 | A1 | 11/2001 |
| EP | 1348754 | A2 | 10/2003 |
| EP | 1424322 | A1 | 6/2004 |
| EP | 1669433 | A1 | 6/2006 |
| EP | 1770151 | A | 4/2007 |
| EP | 1970430 | A | 9/2008 |
| JP | 5626996 | A | 3/1981 |
| JP | 2003268392 | | 9/2003 |
| JP | 2003268392 | A | 9/2003 |
| WO | 9623855 | | 8/1996 |
| WO | 9623855 | A1 | 8/1996 |
| WO | 9966010 | | 12/1999 |
| WO | 9966010 | A1 | 12/1999 |
| WO | 0138462 | | 5/2001 |
| WO | 0206428 | | 1/2002 |
| WO | 02077130 | | 10/2002 |
| WO | 03070860 | | 8/2003 |
| WO | 2006063161 | A2 | 6/2006 |
| WO | WO 2006063161 | A2 * | 6/2006 |
| WO | 2007070360 | A2 | 6/2007 |

OTHER PUBLICATIONS

European search report, European Patent Office, European Patent Application No. 09157327.9, Sep. 11, 2009.

(Continued)

*Primary Examiner* — Pamela H Weiss
(74) *Attorney, Agent, or Firm* — MH2 Technology Law Group

(57) ABSTRACT

The present disclosure is directed to a hydrocarbyl-substituted succinimide lubricity additive or a hydrocarbyl-substituted succinamide lubricity additive for low sulfur diesel fuel. The additive is derived from an olefin having little to no terminal double bonds and a very high proportion of internal double bonds. The succinimide or succinamide is made by combining the alkylated succinic anhydride with ammonia. Also provided is a method for reducing wear scarring in a compression ignition engine comprising providing to the engine a middle distillate fuel comprising an effective amount of the hydrocarbyl-substituted succinimide and/or hydrocarbyl-substituted succinamide. A method for reducing an average coefficient of friction of a middle distillate fuel in a compression ignition engine comprising providing to the engine the disclosed fuel is also disclosed. Moreover, there is disclosed a method for improving the average film thickness from the combustion of a middle distillate fuel in a compression ignition engine.

13 Claims, No Drawings

(56) References Cited

OTHER PUBLICATIONS

Canadian Intellectual Property Office, Canadian Patent Application No. 2,661,300, Office Action dated Sep. 14, 2011, 2 Pages.
Japanese Office Action dated Jun. 25, 2013, Japanese Application No. 2012-156678, filed Jul. 12, 2012, 8 pages. (including translation).
Author Unknown, Chinese Office Action dated Jul. 3, 2013, Chinese Application No. 200910203970.0, filed Apr. 3, 2009, 11 pages. (including translation).
Author Unknown, Chinese Office Action dated Dec. 31, 2012, Chinese Application No. 200910203970.0, filed Apr. 3, 2009, 14 pages. (including translation).

* cited by examiner

SUCCINIMIDE LUBRICITY ADDITIVE FOR DIESEL FUEL AND A METHOD FOR REDUCING WEAR SCARRING IN AN ENGINE

FIELD OF THE DISCLOSURE

The present disclosure relates to a novel hydrocarbyl-substituted succinimide lubricity additive for diesel fuels. In another embodiment is provided a method for reducing wear scarring in a compression ignition engine comprising providing to the engine a middle distillate fuel comprising an effective amount of the hydrocarbyl-substituted succinimide. There is also disclosed a method for reducing the average coefficient of friction and a method for increasing the average film thickness.

BACKGROUND OF THE DISCLOSURE

EP 0 020 037 discloses that the use of an oil-soluble, $C_{12-36}$ aliphatic hydrocarbyl succinimide or succinamide provides a friction reducing effect when it is incorporated into a lubricating oil, such as for use in a crankcase. The hydrocarbyl succinic anhydride is reacted with ammonia to form the succinimide and/or the succinamide. The reference discloses that the succinimide can also be used in both diesel fuel and gasoline. However, the reference does not teach that the succinimide can be used in low-sulfur fuel compositions. In fact, the reference is silent with respect to low-sulfur fuels. More importantly, the reference does not teach that the succinimide and/or succinamide can be used as a very effective lubricity additive to replace some or all of the conventional lubricity agents in the fuel. The reference does not teach that the succinimide or succinamide can be used to reduce wear scarring in the HFRR test (ASTM D6079). In the U.S. and many other countries on-road diesel fuels are now required to produce a wear scar of 520 microns (U.S.) or 460 microns (Canada, Europe, Japan, etc.) or less when tested according to ASTM D6079.

SUMMARY OF THE DISCLOSURE

In an aspect, there is disclosed a method for reducing wear scarring in a compression ignition engine comprising providing to the engine a middle distillate fuel comprising an effective amount of a hydrocarbyl-substituted succinimide.

There is also disclosed a method for improving (increasing) the average film thickness as measured during an ASTM D6079 test, of a middle distillate fuel in a compression ignition engine comprising providing to the engine the middle distillate fuel comprising an effective amount of a hydrocarbyl-substituted succinimide.

Further, in another aspect, there is disclosed a method for reducing an average coefficient of friction as measured during an ASTM D6079 test of a middle distillate fuel in a compression ignition engine comprising providing to the engine the middle distillate fuel comprising an effective amount of a hydrocarbyl-substituted succinimide.

In yet another embodiment is provided a hydrocarbyl-substituted succinimide lubricity additive for middle distillate fuel, wherein the hydrocarbyl group is derived from an olefin or polyolefin in which the olefin double bond or bonds is/are located not terminally but internally, that is, along the backbone of the olefin or polyolefin. The succinimide is preferably derived by combining the alkenyl or hydrocarbyl substituted succinic anhydride and ammonia in the well-known chemistry of EP 0 020 037. The term "hydrocarbyl" herein can thus also be or include "alkenyl".

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

As used herein the term "succinimide" is meant to encompass the completed reaction product from reaction or interaction between ammonia and a hydrocarbyl-substituted succinic acid or anhydride (or like succinic acylating agent), and is intended to encompass compounds wherein the product may have amide, and/or salt linkages in addition to the imide linkage of the type that results from the reaction or interaction of or contact with ammonia, and an anhydride moiety. By "reacting" herein with regard to the alkylation is meant the product or result of contacting, exposing or bringing together any of the recited components or chemicals, whether a covalent bond, ionic bond, salt or other association is produced.

As used herein, the term "olefin" is meant to encompass olefins, polyolefins, and polymers, oligomers, copolymers and mixtures of said olefins.

The hydrocarbyl-substituted succinimides of this disclosure are well known. They are readily made by first reacting an olefinically unsaturated hydrocarbon of a desired molecular weight with maleic anhydride to form a hydrocarbyl-substituted succinic anhydride. Reaction temperatures of about 100° C. to about 250° C. can be used. With higher boiling olefinically-unsaturated hydrocarbons, good results are obtained at about 200° C. to about 250° C. This reaction can be promoted by the addition of chlorine. Alkenyl succinimides in which the succinic group contains a hydrocarbyl substituent containing at least 40 carbon atoms are described for example in U.S. Pat. Nos. 3,172,892; 3,202,678; 3,216,936; 3,219,666; 3,254,025; 3,272,746; 4,234,435; 4,613,341; and 5,575,823, the disclosures of all of which are hereby incorporated by reference.

The "succinimide" herein can be the product resulting from combining, reacting or otherwise contacting the alkylated or hydrocarbyl-substituted succinic anhydride and ammonia to thus yield a hydrocarbyl-substituted succinimide, succinamide, and mixtures thereof.

Typical olefins most useful in the polyolefins for the present invention include, but are not limited to, internal olefins, branched chain alpha olefins, polymers and copolymers of lower olefins. The olefins for polymerization can be chosen from, for example, ethylene, propylene, butylene, such as isobutylene, 1-octene, 1-hexene, 1-decene and the like. Alpha-olefins must be isomerized to give internal olefins. Useful polymers and/or copolymers derived therefrom can include, but are not limited to, polypropylene, polybutenes, polyisobutene, ethylene-propylene copolymers, ethylene-isobutylene copolymers, propylene-isobutylene copolymers, ethylene-1-decene copolymers and the like.

Hydrocarbyl substituents have also been made from olefin terpolymers. Very useful products can be made from ethylene-$C_{3-12}$ alpha olefin-$C_{5-12}$ non-conjugated diene terpolymers; such as ethylene-propylene-1,4-hexadiene terpolymer;

ethylenepropylene-1,5-cyclooctadiene terpolymer; ethylenepropylenenorbornene terpolymers and the like.

In one embodiment, the hydrocarbyl substituents are derived from butene polymers, for example polymers of isobutylene. Suitable polyisobutenes for use in preparing the succinimide-acids of the present disclosure can in one embodiment include those polyisobutenes that comprise at least about 20% of the more reactive methylvinylidene isomer, for example at least 50%, and as a further example at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808, the disclosures of which are hereby incorporated by reference.

It is preferred herein that the polyolefin has a significant proportion of internal double bonds as opposed to terminal double bonds. It has been discovered that in one embodiment a ratio of internal to terminal (or external or alpha olefin) double bonds equal to or greater than 1:1 (i.e., a 50% mix) is preferred for alkylation of the anhydride. In another embodiment the mix of olefins contains 70% or more internal double bonds. And in a more preferred embodiment the double are all or essentially all internal with, with very little to no terminal double bonds in the polyolefin. Isomerizing a blend of alpha olefins improves the performance herein by moving the terminal double internally. It has been discovered that this characteristic of a polyolefin (high internal olefin content) greatly improves the performance as a lubricity additive of a resulting hydrocarbyl-substituted succinimide.

In another embodiment, it has been discovered that the degree of branching on the polyolefin backbone also significantly impacts the lubricity additive performance of the resulting hydrocarbyl-substituted succinimide. Thus, a mixture of isobutylene oligomers and/or internal olefins can provide improved performance due at least in part to the higher degree of branching. The use of internal olefins leads to increased branching in the reaction of the olefin site with the anhydride.

The branching achieved by use of the internal double bonds and/or the use of the vinylidene moiety and/or the polyisobutylene group provides improved low temperature solubility of the resulting hydrocarbyl-substituted succinimide lubricity additive relative to that of succinimides derived from olefins with terminal double bonds. See Table 3.

The molecular weight of the hydrocarbyl substituent can vary over a wide range. The hydrocarbyl group can have a molecular weight of less than 600. An exemplary range is about 100 to about 300 number average molecular weight, for example from about 150 to about 275, as determined by gel permeation chromatography (GPC). In an aspect, the number average molecular weight of the hydrocarbyl group is less than about 350. Thus, hydrocarbyl groups of predominantly $C_4$-$C_{36}$ are useful herein with $C_{15}$-$C_{18}$ hydrocarbyl groups being particularly effective on the succinimide in providing improved lubricity to the low sulfur middle distillate fuel. In an aspect, hydrocarbyl groups of up to about $C_{24}$ are also useful.

Carboxylic reactants other than maleic anhydride can be employed such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

For example, hydrocarbyl-substituted succinic anhydrides may be prepared by the thermal reaction of an olefin and maleic anhydride, as described, for example in U.S. Pat. Nos. 3,361,673 and 3,676,089, the disclosures of which are incorporated by reference. Alternatively, the substituted succinic anhydrides can be prepared by the reaction of chlorinated olefins with maleic anhydride, as described, for example, in U.S. Pat. No. 3,172,892, the disclosure of which is incorporated by reference. A further discussion of hydrocarbyl-substituted succinic anhydrides can be found, for example, in U.S. Pat. Nos. 4,234,435; 5,620,486 and 5,393,309, the disclosures of which are incorporated by reference.

The mole ratio of maleic anhydride to olefin hydrocarbon can vary widely. It can vary from about 5:1 to about 1:5, for example from about 3:1 to about 1:3, and as a further example the maleic anhydride can be used in stoichiometric excess to force the reaction to completion. The unreacted maleic anhydride can be removed by vacuum distillation.

The reaction between the hydrocarbyl-substituted succinic anhydride and the ammonia can in one embodiment be carded out by mixing the components and heating the mixture to a temperature high enough to cause a reaction to occur but not so high as to cause decomposition of the reactants or products or the anhydride may be heated to reaction temperature and the ammonia added over an extended period. A useful temperature is about 100° C. to about 250° C. Exemplary results can be obtained by conducting the reaction at a temperature high enough to distill out water formed in the reaction.

The hydrocarbyl-substituted succinimide can be present in the middle distillate fuel composition in any desired or effective amount. In an aspect, the hydrocarbyl-substituted succinimide can be present in an amount ranging from about 10 ppm to about 500 ppm, for example from about 20 ppm to about 300 ppm, and as a further example from about 50 to about 150 ppm by weight, relative to the total weight of the fuel composition.

Middle distillate fuels for use in the disclosed composition include, but are not limited to, jet fuels, diesel fuels, and kerosene. In an aspect, the fuel is a low-sulfur fuel of less than about 15 ppm sulfur, and in another aspect the fuel is an ultra-low sulfur diesel fuel or an ultra-low sulfur kerosene. In one embodiment herein "ultra-low-sulfur" means an amount of sulfur up to about 15 ppm, and in another embodiment the amount of sulfur is less than about 10 ppm. The present disclosure encompasses jet fuels, although these are conventionally not regarded as "low-sulfur" or "ultra-low sulfur" fuels since their sulfur levels can be comparatively quite high. Nevertheless, it has been discovered that jet fuels also benefit from the disclosures and methods herein and thus for purposes of the present disclosure "low-sulfur fuels" and "ultra-low sulfur fuels" herein shall include jet fuels regardless of their sulfur content.

The middle distillate low-sulfur fuel compositions of the present disclosure can contain other additives. Non-limiting examples of additives include dispersants/detergents, antioxidants, thermal stabilizers, carrier fluids, metal deactivators, dyes, markers, corrosion inhibitors, biocides, antistatic additives, drag reducing agents, demulsifiers, emulsifiers, dehazers, anti-icing additives, antiknock additives, anti-valve-seat recession additives, surfactants, other lubricity additives, combustion improvers, cetane number improvers and mixtures thereof. In another embodiment, the fuel can be free of or essentially free of other lubricity additives, such as but not limited to, amines, amides, carboxylic acids and esters.

Thus, there is provided herein an improved low-sulfur diesel fuel composition comprising low-sulfur diesel fuel (having a sulfur content of less than 50 ppm and more preferably less than 15 ppm sulfur), and further comprising a lubricity additive comprising a hydrocarbyl-substituted succinimide or succinamide or mixture thereof derived from the reaction product of an olefin having a significant proportion of internal double bonds and a carboxylic reactant followed by reaction with and ammonia.

In another embodiment the middle distillate fuel contains the hydrocarbyl-substituted succinimide or hydrocarbyl-substituted succinamide described herein but is otherwise free of or essentially free of a mono- or di-carboxylic acid lubricity additive, an amide lubricity additive, an alcohol or diol lubricity additive, an ester lubricity additive or an amine lubricity additive.

In an aspect, there is disclosed a method for reducing wear scarring in a compression ignition engine comprising providing to the engine an effective amount of the disclosed hydrocarbyl-substituted succinimide. Moreover, there is disclosed herein a method for decreasing the average coefficient of friction of a fuel in an engine comprising providing to the engine of the vehicle a low-sulfur middle distillate fuel comprising an effective amount of the hydrocarbyl-substituted succinimide disclosed herein. Further, there is disclosed a method for improving the average film thickness of a fuel in an engine. One of ordinary skill in the art would understand that "decreasing the average coefficient of friction" and "improving the average film thickness" is understood to be as compared to a vehicle utilizing an engine combusting a middle distillate fuel that does not comprise an effective amount of a hydrocarbyl-substituted succinimide. One of ordinary skill in the art would also understand that as friction in a vehicle is thus reduced, then its fuel mileage, and/or fuel economy, is increased. This can be both from introduction of the present succinimide from the fuel into the lubricant of the engine, as well as the direct friction-reducing effect of the succinimide on the piston and cylinder surfaces.

EXAMPLES

Preparation of a Hydrocarbyl-Substituted Succinic Anhydride

An olefin and maleic anhydride were placed in a stainless steel pressure reactor. Maleic anhydride was present in a 3-5% molar excess (1.03-1.05 maleic anhydride: 1 olefin). A small amount (~200 ppm) of aluminum chloride was also added to reduce tarring during the reaction. The reactor was heated to about 60° C. to melt the maleic anhydride, purged with nitrogen and sealed. The reactants were stirred and heated to 225° C. and held there for 4 hours. The product was transferred to a flask and heated, under vacuum, to 200° C. for one hour to remove any unreacted maleic anhydride.

Preparation of Succinimide

The prepared hydrocarbyl-substituted succinic anhydride was stirred and heated to 150° C. in a flask equipped with a nitrogen purge and a Dean-Stark trap. Ammonia was then injected at a slow rate and the temperature was increased to 172° C. Ammonia injection continued until the reaction stopped producing water. Infrared spectroscopy indicated that in all examples, the principal product was hydrocarbyl-substituted succinimide.

Table 1 provides a description of the various reactants that were used in the process described above to make the disclosed hydrocarbyl-substituted succinimides.

TABLE 1

| Reactants | |
|---|---|
| ADDITIVE EXAMPLE | REACTANTS |
| 1 | "16 ASA" alkenyl succinic anhydride/ammonia |
| 2 | Blend of $C_{16}$-$C_{18}$ alpha olefin/maleic anhydride/ammonia |
| 3 | Blend of $C_{20}$-$C_{24}$ vinylidene and alpha olefins/maleic anhydride/ammonia |
| 4 | Mixture of isobutylene oligomers ranging from $C_4$-$C_{36}$ (with a peak at $C_{16}$)/maleic anhydride/ammonia |
| 5 | Mixture of isobutylene oligomers ranging from $C_4$-$C_{36}$ (with a peak at $C_{12}$)/maleic anhydride/ammonia |
| 6 | Polyisobutylene (polybutenes with Mn = 220)/maleic anhydride/ammonia |
| 7 | Polyisobutylene (polybutenes with Mn = 370)/maleic anhydride/ammonia |
| 8 | Blend of $C_{15}$-$C_{18}$ internal olefin/maleic anhydride/ammonia |

Additive 1 "16 ASA" is a tradename of Albemarle Corporation and is an alkenyl succinic anhydride produced from the reaction of internal olefins (primarily $C_{16}$) and maleic anhydride.

Additive 2 employed an olefin blend obtained from Innovene LLC having no branching and less than 10% by weight of olefin having internal double bonds.

Additive 3 employed an olefin blend obtained from Innovene LLC.

Additive 4 employed an oligomer blend obtained from Texas Petrochemicals Inc.

Additive 5 employed an oligomer blend obtained from Texas Petrochemicals Inc.

Additive 6 employed a polyisobutylene obtained from Innovene LLC.

Additive 7 employed a polyisobutylene obtained from Innovene LLC.

Additive 8 employed an olefin obtained from Shell Chemical Company.

The alkenyl- or hydrocarbyl-substituted succinimides prepared above were used to make lubricity additives to prepare various middle distillate fuel compositions in Table 2. The middle distillate fuel compositions were then subjected to a high frequency reciprocating rig test (ASTM D6079) wherein the average HFRR wear scar diameter was recorded. The lower the wear scar diameter indicated that the fuel composition had exhibited an improvement in lubricity relative to control having no additive. The results of the HFRR test are shown in Table 2.

TABLE 2

| HFRR (ASTM D6079) | | | | | |
|---|---|---|---|---|---|
| FUEL | ADDITIVE EXAMPLE | TREAT RATE (mg/liter) | Avg. Friction Coeff. | Avg. HFRR Wear Scar Diam. (microns) | Avg. Film (%) |
| A | None | — | 0.289 | 640 | 1.7 |
| A | 1 | 100 | 0.192 | 495 | 20.8 |
| A | 1 | 125 | 0.187 | 458 | 24.5 |
| A | 2 | 100 | 0.181 | 435 | 37.4 |
| A | 3 | 100 | 0.220 | 550 | 12.8 |
| A | 3 | 125 | 0.189 | 470 | 28.9 |
| A | 4 | 100 | 0.212 | 505 | 4.5 |
| A | 5 | 100 | 0.217 | 525 | 4.0 |
| A | 5 | 125 | 0.210 | 435 | 13.9 |
| A | 6 | 100 | 0.264 | 575 | 2.3 |
| A | 7 | 100 | 0.285 | 630 | 0.3 |
| A | 8 | 100 | 0.197 | 450 | 19.2 |
| B | None | — | 0.486 | 730 | 15.2 |
| B | 1 | 87 | 0.190 | 460 | 67.6 |
| B | 1 | 108 | 0.180 | 385 | 60.0 |
| B | 8 | 100 | 0.209 | 500 | 32.8 |
| B | 8 | 125 | 0.186 | 405 | 34.1 |
| C | None | — | 0.356 | 600 | 4.8 |
| C | 1 | 87 | 0.195 | 375 | 48.7 |
| D | None | — | 0.319 | 555 | 1.4 |
| D | 1 | 87 | 0.211 | 480 | 22.8 |
| D | 1 | 108 | 0.200 | 410 | 31.6 |
| E | None | — | 0.467 | 550 | 18.7 |

TABLE 2-continued

| HFRR (ASTM D6079) | | | | | |
|---|---|---|---|---|---|
| FUEL | ADDITIVE EXAMPLE | TREAT RATE (mg/liter) | Avg. Friction Coeff. | Avg. HFRR Wear Scar Diam. (microns) | Avg. Film (%) |
| E | 1 | 87 | 0.227 | 470 | 12.6 |
| E | 1 | 108 | 0.209 | 425 | 12.1 |

Fuel A = Jet A fuel
Fuel B = #1 Ultra-low sulfur diesel (ULSD) fuel
Fuel C = Ultra-low sulfur kerosene (ULSK)
Fuel D = #2 ULSD Fuel
Fuel E = #1 ULSD Fuel As can be seen from Table 2, the present disclosure provides improved lubricity in the low-sulfur fuel as evidenced by the reduced wear scar result compared to unadditized fuel in the HFRR rig test. In general, the best lubricity results were obtained when the peak of the olefin content distribution was about $C_{15-18}$. Thus, additive examples 1, 2, 4 and 8, which had peak hydrocarbyl distributions at $C_{15-18}$, gave excellent HFRR wear scar lubricity results in the various fuels tested.

Moreover, the data in Table 2 also teaches that the disclosed low-sulfur fuel compositions exhibited a reduced average coefficient of friction as compared to unadditized fuel in the HFRR rig test. One of ordinary skill in the art would understand how to calculate the coefficient of friction using the HFRR test rig.

The average film thickness of the fuel compositions was also measured. A contact resistance circuit applied a 15 mV potential across the specimen contact and a balance resistor in series. The series resistance was set to 10 Ohms. A low film reading meant that the potential drop across the contact, and hence the contact resistance was low and was associated with high friction force and high wear. Conversely, a high film reading meant that the metal surfaces were being separated; there was low friction force, and low wear. As can be seen from the data in Table 2, the present disclosure provides improved average film thickness as evidenced by the increased average film thickness as compared to unadditized fuel compositions.

TABLE 3

| Cold storage of additive dilutions | |
|---|---|
| Additive Example | Appearance of 50% additive dilution after 7 days storage at −20° C. |
| 1 | Clear flowable liquid with no crystals |
| 2 | Opaque solid |
| 3 | Opaque solid |
| 4 | Clear flowable liquid with no crystals |
| 5 | Clear flowable liquid with no crystals |
| 6 | Clear flowable liquid with no crystals |
| 7 | Clear flowable liquid with no crystals |
| 8 | Clear flowable liquid with no crystals |

In the United States, most diesel fuel lubricity additives are stored and injected into the fuel from tanks at pipeline terminals. Therefore; it is important that the lubricity additive not only remain a homogeneous flowable liquid at the lowest temperatures that might be encountered at a given terminal location, but must ideally also provide the desired lubricity performance. To test the additive examples' ability to remain a flowable liquid at low temperature, each was dissolved at 50% by weight in Aromatic 100 solvent (obtained from ExxonMobil Chemical) and then placed in cold storage at −20° C. After 7 days, the samples were inspected visually. The results are shown in Table 3.

Additive example 2 (Blend of $C_{16}$-$C_{18}$ alpha olefin/maleic anhydride/ammonia) provided acceptable wear scar of 435 microns at a treat rate of 100 mg/l, but the additive displayed less desirable low temperature performance due to the lower degree of branching relative to the other samples, Similarly, additive example 3 (containing a blend of vinylidene and alpha olefins) had acceptable wear scar performance but reduced low temperature solubility due to high terminal olefin content.

One embodiment herein provides a diesel fuel lubricity additive obtained by reacting an olefin having less than 10% of its double bonds as terminal double bonds with maleic anhydride, followed by reacting the resulting hydrocarbyl-substituted anhydride with ammonia to produce a hydrocarbyl-substituted succinimide. In a preferred embodiment, the double bonds of the olefin are completely internal.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel composition comprising a major proportion of a middle distillate fuel and a minor proportion of a lubricity additive said additive comprising a hydrocarbyl-substituted succinimide prepared by combining an olefin and maleic anhydride to form a hydrocarbyl-substituted succinic anhydride and combining said hydrocarbyl-substituted succinic anhydride with ammonia to produce a hydrocarbyl-substituted succinimide, wherein the olefin is selected from the group consisting of (a) a mixture of oligomers, wherein the percentage of internal olefin oligomer is greater than 50% of the total olefin content; (b) a mixture of isobutylene oligomers; and (c) combinations thereof;

wherein the olefin comprises a number average molecular weight of from about 150 to about 275; and wherein the lubricity additive is present in the fuel composition in an amount ranging from about 20 to about 300 ppm.

2. The fuel composition of claim 1, wherein the olefin has less than 10% terminal double bonds.

3. The fuel composition of claim 1, wherein the olefin comprises a blend of isobutylene oligomers.

4. The fuel composition of claim 1, wherein the olefin comprises a blend of $C_{15}$-$C_{18}$ internal olefins.

5. A method for reducing wear scarring in a compression ignition engine comprising:

providing to the engine the fuel composition of claim 1.

6. The method of claim 5, wherein the olefin comprises a blend of isobutylene oligomers.

7. The method of claim 5, wherein the olefin comprises a blend of $C_{15}$-$C_{18}$ internal olefins.

8. The method of claim 5, wherein the wear scar of the fuel comprising the lubricity additive of claim 1 is less than 500 microns in the HFRR test of ASTM D 6079.

9. A method for reducing an average coefficient of friction of a middle distillate fuel in a compression ignition engine comprising:

providing to the engine the fuel composition of claim 1.

10. A method for increasing the average film thickness of a middle distillate fuel in a compression ignition engine comprising:

providing to the engine the fuel composition of claim 1.

11. A method for improving fuel economy of an engine combusting middle distillate fuel comprising:

combusting in said engine the fuel composition of claim 1.

12. The fuel composition of claim 1, wherein the olefin comprises a mixture of isobutylene oligomers and internal olefins.

13. The method of claim 5, wherein the olefin comprises a mixture of isobutylene oligomers and internal olefins.

* * * * *